US006196748B1

(12) United States Patent
Schwartz

(10) Patent No.: US 6,196,748 B1
(45) Date of Patent: Mar. 6, 2001

(54) FOLDER BINDER

(75) Inventor: David C. Schwartz, Southboro, MA (US)

(73) Assignee: Productive Environments, Inc, Framingham, MA (US)

( * ) Notice: Subject to any disclaimer, the term of this patent is extended or adjusted under 35 U.S.C. 154(b) by 0 days.

(21) Appl. No.: 09/465,911

(22) Filed: Dec. 17, 1999

Related U.S. Application Data

(60) Provisional application No. 60/112,754, filed on Dec. 17, 1998.

(51) Int. Cl.[7] ..... B42F 3/00

(52) U.S. Cl. ..... 402/8; 402/13; 402/80 P; 281/29

(58) Field of Search ..... 402/8, 4, 70, 73, 402/13, 80 P; 281/29, 36, 37, 38

(56) References Cited

U.S. PATENT DOCUMENTS

| | | | | |
|---|---|---|---|---|
| 2,324,259 | * | 7/1943 | Havel | 402/8 |
| 3,507,601 | * | 4/1970 | Smith | 402/8 |
| 4,135,832 | * | 1/1979 | Saltz | 402/8 |
| 5,213,429 | * | 5/1993 | Johnson | 402/8 |

* cited by examiner

*Primary Examiner*—Willmon Fridie, Jr.

(57) ABSTRACT

What is provided is a folio having at least one set of interleaved attachment tabs hingedly formed at the folio spine, comprising a first tab and a second nested tab, where both tabs share the same spine axis, and where each tab provides a means for attaching a leaf thereto, whether by providing a surface for fixedly attaching a leaf to or by providing a structural support for attaching a leaf thereto.

6 Claims, 3 Drawing Sheets

Fig. 1
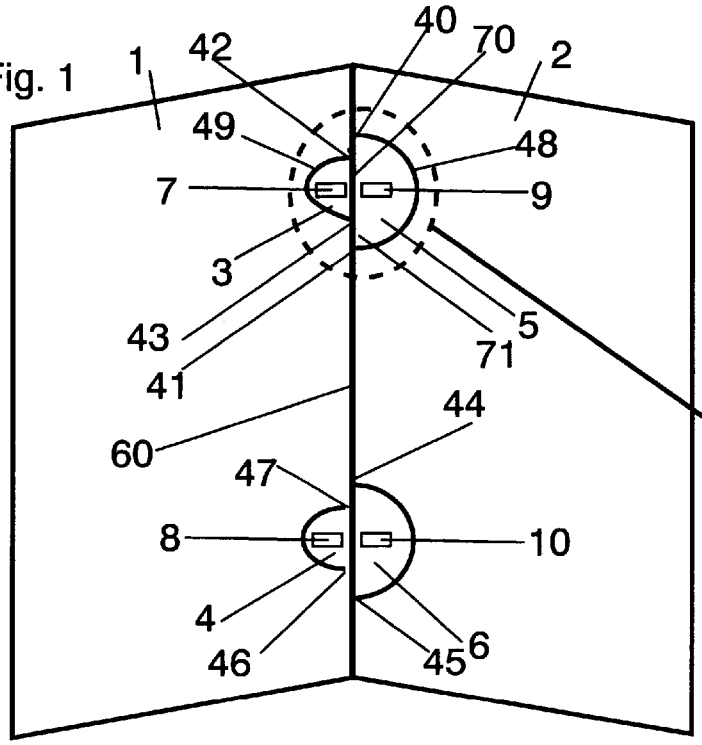
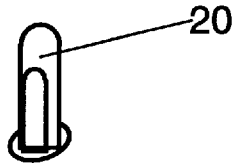
Fig.1a
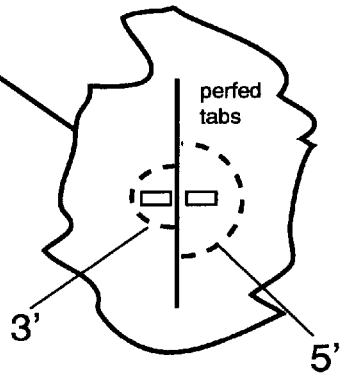
Fig. 2
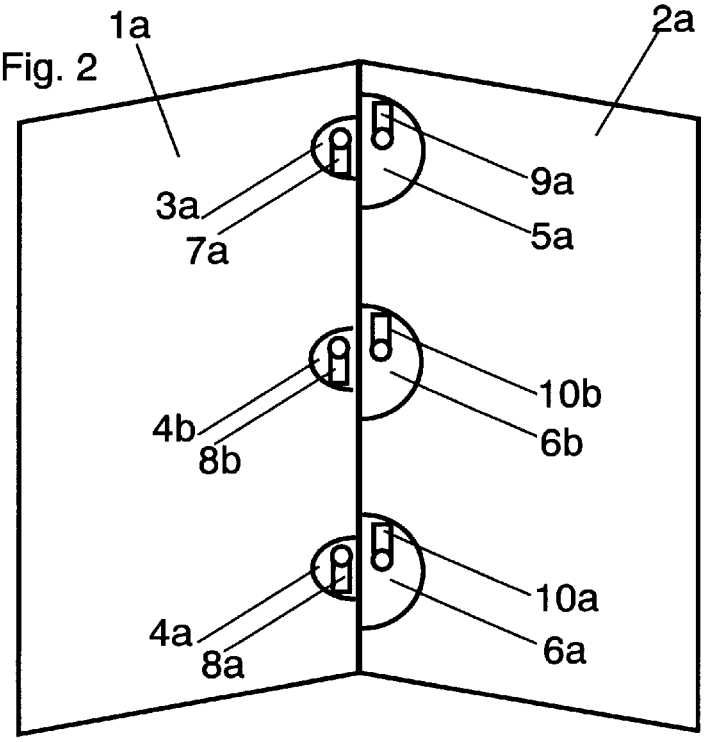
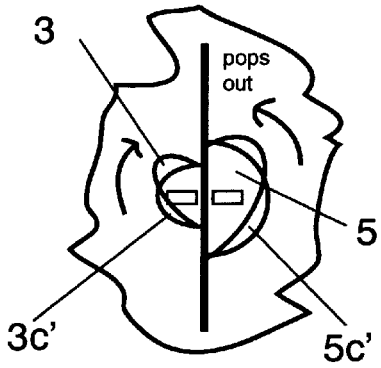
Fig. 1b

FOLDER BINDER

This Patent Application is a formal utility patent filing on Provisional patent application "Folder Binder", 60/112,754, filed Dec. 17, 1998 (Dec 17, 1998).

BACKGROUND OF THE INVENTION

This invention relates to portfolios and in particular to portfolios with a spine that provides for means for attaching additional leaves thereto.

The invention relates to portfolios that offer attachment means for providing a plurality of leaves which may be removably or fixedly attached to a spine of a host portfolio and alternatively turned as leaves of that host portfolio.

The invention relates particularly to a highly efficient means for adding multiple leaves to a portfolio spine that eliminates the need to add additional spine attachment strips, offers the highest packing density of attachment tabs for a length of spine, and eliminates the need to put separator material between spine tabs.

Tanged file folders have been available. Such file folders provide for two or three tangs on one or both covers. Additionally, tanged strips are a feature of many file folders, stapled into the spine or folded as a part of the spine. The placement of tangs in any one of the above mentioned devices can be replaced by the combination of a hole and a spreadable clip and represent the basis for commercially available products and known art.

This invention relates to filing products intended to offer a hinged tang without requiring an additional strip for offering the hinging facility. Further, this invention intends to provide for at least two opposing hinged tabs of differing tab base widths, substantially coterminous one with the other for allowing the attachment of independent leaves, each hinging on one or the other of the tabs.

The limitation of attaching a leaf directly on a cover is that the leaf directly attached thereto does not hinge and swing freely. For example, the limitation of an additional hinged strip with tangs is the cost of stapling or gluing in the tang strip. This is a manufacturing and cost limitation.

SUMMARY OF THE INVENTION

The object of the present inventions to provide for a multiple hinged file folder with attachment tabs for attaching a plurality of leaves at a spine without having to add an extra strip of material. The object is to provide for a way to extend a traditional dual port folder or file folder or like object by providing a set of perfed tabs that can be popped out to provide hinged tabs either for receiving a clip, or with adhesive to attache to, or if in plastic to be bonded to, or with a preinstalled tang. The object is to provide for a slitted perfed or popped out tab where the slit is for securely receiving a spreadable clip when such means is employed instead of a tang.

BRIEF DESCRIPTION OF THE DRAWINGS

FIG. 1 shows a folio capable of receiving 2 add-in leaves

FIG. 2 shows a tanged folio capable of receiving two add in leaves

FIG. 1*a* shows a perf means for providing an alternating tab set

FIG. 1*b* shows how the tabs hinge at a common spine axis

PARTS DESCRIPTION

Figure 3:
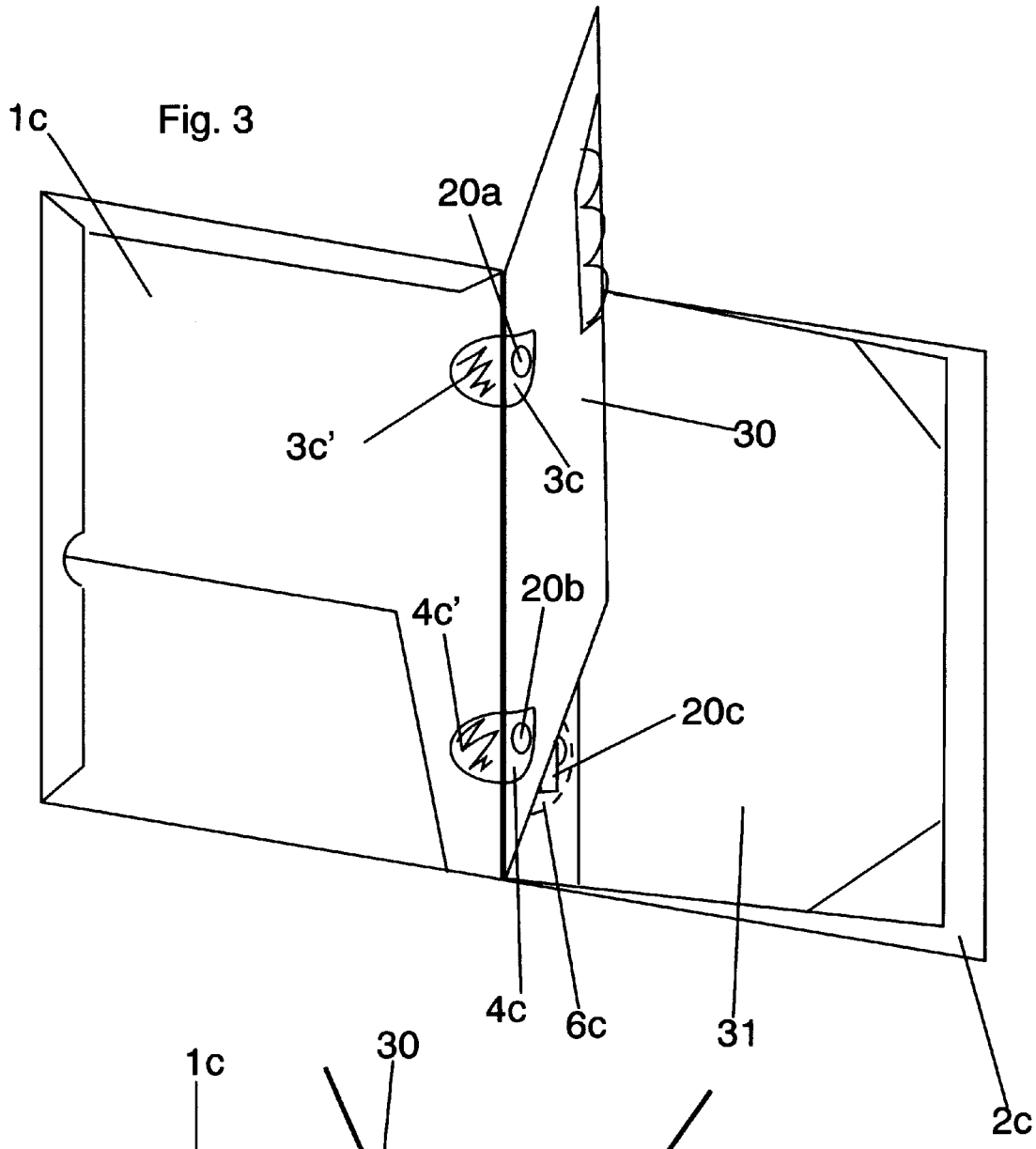
FIG. 3 shows a perspective view of a dual portfolio having two leaves attached to two alternating tab sets.
Figure 4:
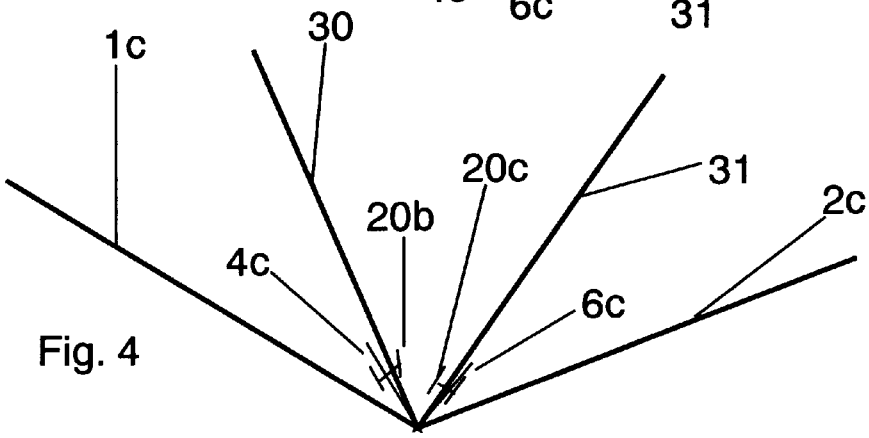
FIG. 4 shows a side edge view of FIG. 3
Figure 5:
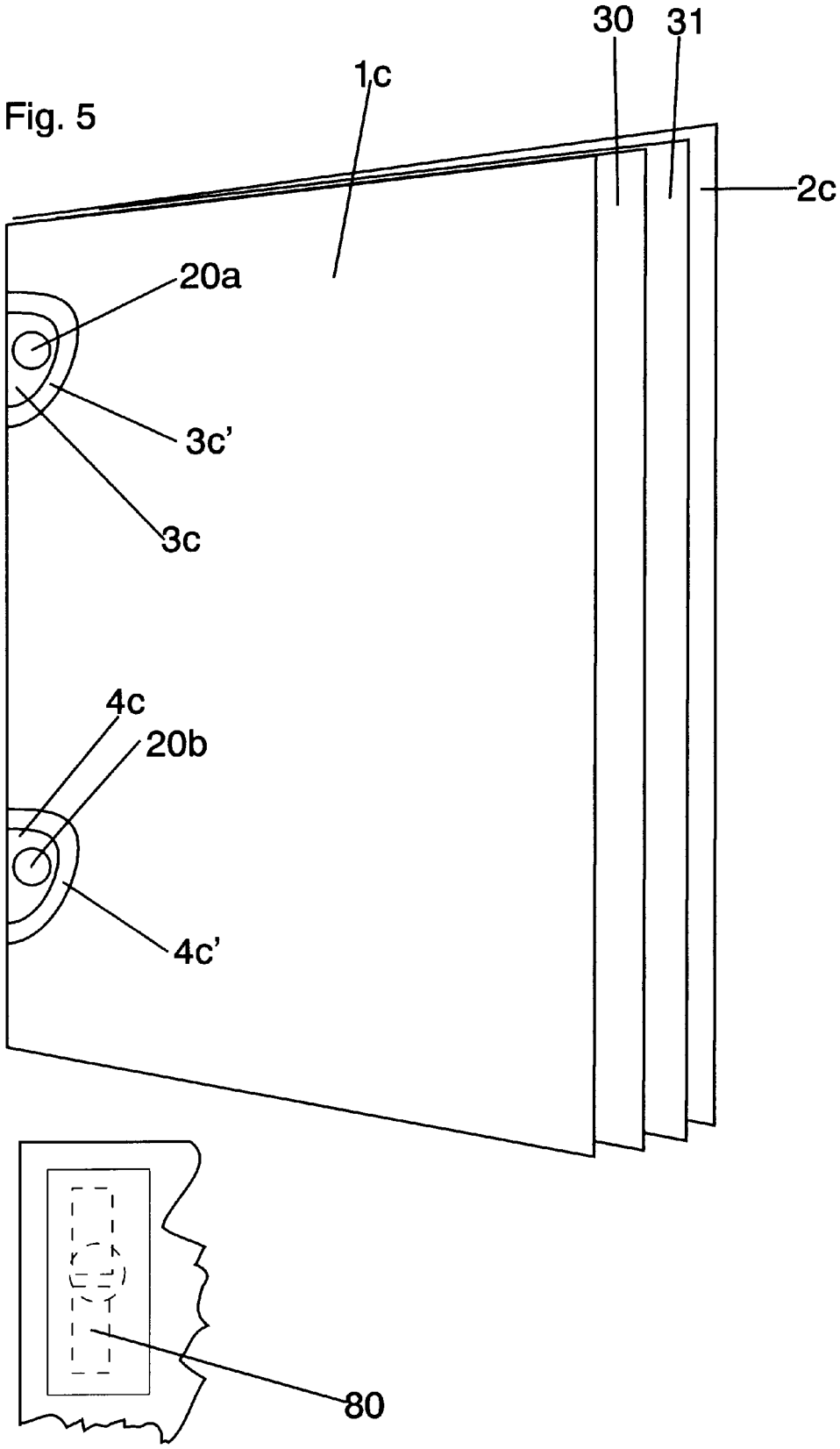
FIG. 5 shows the folio of FIG. 3 closed.

| Part # | Description |
|---|---|
| 1 | front cover of folder |
| 2 | back cover of folder |
| 3 | upper front cover hinged tab |
| 4 | lower front cover hinged tab |
| 5 | upper back cover hinged tab |
| 6 | lower back cover hinged tab |
| 7 | upper hinged tab slit on front cover |
| 8 | lower hinged tab slit on back cover |
| 9 | upper hinged tab slit on back cover |
| 10 | lower hinged tab slit on rear cover |
| 20 | pronged clip with 2 spreadable sides and a head |
| 20a | a first pronged clip inserted into a tab slit |
| 20b | a second pronged clip inserted into a tab slit |
| 1a | front cover |
| 2a | back cover |
| 3a | upper hinged tab front cover |
| 4a | lower hinged tab front cover |
| 4b | middle hinged tab front cover |
| 5a | upper hinged tab back cover |
| 6b | middle hinged tab back cover |
| 7a | tang two prong tang pre installed |
| 8a | " |
| 8b | " |
| 9a | " |
| 10a | " |
| 10b | " |
| 3' | perfed hinged tab profile front cover |
| 5' | perfed hinged tab profile rear/back cover |
| 4c | lower front cover tab |
| 3c' | hole formed by tab 3c |
| 4c' | hole formed by tab 4c |
| 5c' | hole formed by tab 5 |
| 6c | rear lower tab |
| 30 | pocket leaf type 1 |
| 31 | pocket leaf type 2 |
| 1c | reinforced front cover |
| 2c | reinforced rear cover |
| 3c | upper front cover tab |
| 40 | upper end of upper rear tab |
| 41 | lower end of upper rear tab |
| 42 | upper end of front rear tab |
| 43 | lower end of front rear tab |
| 44 | upper end of lower rear tab |
| 45 | lower end of lower rear tab |
| 46 | lower end of front tab |
| 47 | upper end of front tab |
| 48 | curved tab profile rear upper tab |
| 49 | curved tab profile front upper tab |
| 71 | hinge portion between lower end front upper tab and lower end rear upper tab |
| 70 | hinge portion between upper end of rear tabs and upper end of front tab |
| 80 | label strip for covering tangs |

DETAILED DESCRIPTION OF THE INVENTION

A preferred embodiment as shown in FIG. 1 provides for a folder with front cover 1 and back cover 2. Tab 3 has a receiving slot 7 for receiving a pronged clip. Tab 5 opposes tab 3 and has top portion 40 and bottom portion 41 which extend past top portion 42 and bottom portion 43 of tab 3. This results in a construct hinge 70 and 71 formed there between for allowing each tab 3 and 5 to swing freely one with respect to the other. The tabs can have any shape, 48 and 49 being curved. When a prong clip is used the head of the clip must be accommodated by positioning prong slot 9 far enough from the top of the curved cut out 48 so as not to allow the head to catch on cover 2 when tab 5 is freely pivoted with a leaf attached there to a pronged clip 20.

Construction, can be made in paper board. If paper board is used, a film or strip laminate may be desirable on a portion or all of the spine covering at least the tabs so as to provide more durability.

Alternatively, the host cover can be made in a clear or opaque plastic.

Rather than attaching merely leaves of paper, a preferred application is to attach card dividers. This allows for the creation of a classification folder. Alternatively, pockets can be attached which are more rigid and into which paper or other leaves can be inserted.

To cover the tangs, a sticky "label" can be used. This will prevent the hitching of paper edges when loose leaves are inserted.

The primary advantage of the dual interleaving tab set is that it takes up sell spine extent than if the tabs were offset one from the other. This enables a higher packing density of tab sets on a spine and there by allows for a larger number of leaf attachments.

The means for attaching leaves would depend on the material the folio and leaves were made from as well as the application specific requirements. The tab system allows for customer or user assembly in the case of providing slits or tangs. If adhesive is used, it can be on a peel strip. Alternatively, in poly plastic, poly plastic leaves can be bonded directly to the tabs, or in the case of paper board, adhesive beads can be laid down automatically, components laid on top, and the set of leaves plowed over to form a completed folio.

What is claimed is:

1. A folder having a front cover and a rear cover, said front and rear covers hinged together at a spine, said each of said front and rear covers each having at least one set of opposing hinged tabs, a front cover hinged tab and a rear cover hinged tab, said each of said tabs hinged at said spine, one to the other, said each of said tabs having a tab profile and an upper and lower end, where in said each of said tab profile sections is removably cut into said each of said covers so as to be able to be moved free of said covers, and where in said front cover hinged tab has a first spine extent as the distance between said front cover hinged tab upper end and said front cover hinged tab lower end, and said rear cover hinged tab has a second spine extent as the distance between said rear cover hinged tab upper end and said rear cover hinged tab lower end, such that one of said front cover hinged tab spine extent and said rear cover hinged tab spine extent has a spine extent that is larger than the other hinged tab spine extent, and where the shorter extent is positioned to lie within the larger extent leaving a landed hinge section for the longer extent above and below said shorter extent, such that each tab can hinge at the spine along said common hinged portion spine extent between the upper and lower end of the shorter of the two spine extents and where each of said front and rear cover hinged tabs can hinge freely one with respect to the other, said each of said tabs for receiving a fastener there through for joining one or more leaves at said spine of said folder, said one or more leaves to be joined by said fastener.

2. The folder of claim 1 where in said tab profile is removably cut with a full cut which frees said profile from said cover portion of which it is a part.

3. The folder of claim 1 where in said tab profile is removably cut with a perforation which may be popped free to allow said profile to be free of sad cover portion of which it is a part.

4. A folder having a front cover and a rear cover formed from paperboard, said front and rear covers hinged together at a spine, said each of said front and rear covers each having at least one set of opposing hinged tabs, a front cover hinged tab add a rear cover hinged tab, said each of said tabs hinged at said spine, one to the other, said each of said tabs having a tab profile and an upper and lower end, where in said each of said tab profile sections is removably cut into said each of said covers so as to be able to be moved free of said covers, and where in said front cover hinged tab has a first spine extent as the distance between said front cover hinged tab upper end and said front cover hinged tab lower end, and said rear cover hinged tab has a second spine extent as the distance between said rear cover hinged tab upper end and said rear cover hinged tab lower end, such that one of said front cover hinged tab spine extent and said rear cover hinged tab spine extent has a spine extent that is larger than the other hinged tab spine extent, and where the shorter extent is positioned to lie within the larger extent leaving a landed hinge section for the longer extent above and below said shorter extent, such that each tab can hinge at the spine along said common hinged portion spine extent between the upper and lower end of the shorter of the two spine extents and where each of said front and rear cover hinged tabs can hinge freely one with respect to the other, said each of said tabs for receiving a fastener there through for joining one or more leaves therebetween at said spine of said folder.

5. The folder of claim 4 where said each of said tabs has a fastening means formed in each of said opposing hinged tabs.

6. A folder having a front cover and a rear cover formed from polyplastic, said front and rear covers hinged together at a spine, said each of said front and rear covers each having at least one set of opposing hinged tabs, a front cover hinged tab and a rear cover hinged tab, said each of said tabs hinged at said spine, one to the other, said each of said tabs having a tab profile and an upper and lower end, where in said each of said tab profile sections is removably cut into said each of said covers so as to be able to be moved free of said covers, and where in said front cover hinged tab has a first spine extent as the distance between said front cover hinged tab upper end and said front cover hinged tab lower end, and said rear cover hinged tab has a second spine extent as the distance between said rear cover hinged tab upper end and said rear cover hinged tab lower end, such that one of said front cover twinged tab spine extent and said rear cover hinged tab spine extent has a spine extent that is larger than the other hinged tab spine extent, and where the shorter extent is positioned to lie within the larger extent leasing a landed hinge section for the longer extent above and below said shorter extent, such that each tab can hinge at the spine along said common hinged portion spine extent between the upper and lower end of the shorter of the two spine extents and where each of said front and rear cover hinged tabs can hinge freely one with respect to the other, said each of said tabs for bonding one or more leaves therebetween.

* * * * *